United States Patent [19]

Casiday

[11] 4,369,829

[45] Jan. 25, 1983

[54] WINDOW UNIT FOR STORM WINDOWS

[76] Inventor: John J. Casiday, 501 Third St., White Bear Lake, Minn. 55110

[21] Appl. No.: 161,860

[22] Filed: Jun. 23, 1980

[51] Int. Cl.[3] ..... E06B 9/08

[52] U.S. Cl. ..... 160/120; 160/25; 160/26; 160/241; 160/269

[58] Field of Search ..... 160/25, 26, 98, 120, 160/239, 241, 269, 270, 238; 49/62, 63

[56] References Cited

U.S. PATENT DOCUMENTS

| | | | |
|---|---|---|---|
| 1,751,950 | 3/1930 | Sacerdote | 160/269 |
| 1,756,496 | 4/1930 | Warnick | 160/26 X |
| 1,908,989 | 5/1933 | Lahey et al. | 160/26 X |
| 2,009,917 | 7/1935 | Flanagan | 20/40 |
| 2,361,762 | 10/1944 | Glenn et al. | 160/23 |
| 2,592,805 | 4/1952 | Hutchinson | 160/98 |
| 2,769,491 | 11/1956 | Pitcoff | 160/269 X |
| 2,847,064 | 8/1958 | Roth | 160/267 |
| 4,126,174 | 11/1978 | Moriarty et al. | 160/266 |
| 4,237,956 | 12/1980 | Sivin et al. | 160/25 X |
| 4,258,517 | 3/1981 | Hammond | 160/290 R X |
| 4,282,919 | 8/1981 | Teno | 160/290 R X |

FOREIGN PATENT DOCUMENTS

| | | | |
|---|---|---|---|
| 499880 | 1/1939 | United Kingdom | 160/269 |
| 509797 | 7/1939 | United Kingdom | 160/269 |
| 636361 | 12/1978 | U.S.S.R. | 160/98 |

*Primary Examiner*—Rodney H. Bonck

*Attorney, Agent, or Firm*—Merchant, Gould, Smith, Edell, Welter & Schmidt

[57] ABSTRACT

Window unit (2) includes a window casing (4) having a plurality of flexible plastic sheets (6) mounted on spring rollers (30). Sheets (6) can be unrolled into an operative position where they are spaced in front of a transparent window panel to act as storm windows. Rectangular sealing frames (8) are movable in casing (4) between a first position in which the frames (8) are spaced apart to receive the plastic sheets (6) therebetween and a second position in which the frames (8) are pressed together to trap and seal the plastic sheets (6) therebetween. Frames (8) are movable manually by elongated shafts (50) which pass through key hole slot (56) in window casing (4).

15 Claims, 6 Drawing Figures

WINDOW UNIT FOR STORM WINDOWS

TECHNICAL FIELD

This invention relates to a window unit for providing storm windows usable in conjunction with a transparent window panel of a generally conventional type, e.g. a transparent glass pane. More particularly, the window unit of this invention utilizes flexible plastic sheets as the storm windows. Novel structure is provided for sealing these sheets against air infiltration to allow them to effectively act as storm windows.

BACKGROUND OF THE INVENTION

Buildings are often built with transparent glass windows to allow natural sunlight into the building and to afford its occupants a "view of the outside". Windows are aesthetically pleasing for these reasons. Unfortunately, heat is relatively easily transferred through glass windows. This heat transfer increases the costs for heating and air conditioning the building. This, of course, is not desirable.

Storm windows have long been recognized as one solution for decreasing heat transfer through a glass window. Normally, a storm window is mounted on the outside of the building in front of the regular, permanently installed window, e.g. a double hung window with movable sashes, contained in the wall of the building. Besides adding an additional layer of glass, storm windows create an air space in front of the regular window which acts as insulation. Storm windows usually comprise a transparent glass pane of approximately the same size as the regular window mounted in some type of frame. Some storm windows must be removed and installed each year. Other storm windows, of the so-called "triple track type", are permanently installed and represent a slidable glass pane. The glass pane can be slid down to function as a storm window or slid up during the summer with a screen being slid down in its place.

The conventional storm windows noted above have various disadvantages. They are relatively expensive since they comprise a solid glass pane of approximately the same size as the normal window. They are relatively heavy which makes them hard to remove or install if they are of the removable type. In addition, the permanently installed storm windows of the triple track type are exactly what that name implies. They are permanently mounted on the outside of the building and to some degree obstruct the view, especially the screen portions of the unit.

Various storm windows have been proposed comprising flexible plastic sheets which may be wound up onto a spring roller. These sheets may be unrolled when use of a storm window is desired and placed in front of the regular window. Various types of sealing means are employed in an attempt to seal the flexible plastic sheet against air infiltration. When the storm window is not needed or not desired, the sheet is wound up onto the spring roller and can be easily hidden from view. Therefore, it does not have the disadvantages of permanently mounted storm windows.

Many of the prior art storm windows made from flexible plastic sheets have various disadvantages. Some of these disadvantages relate to the means used to seal the plastic sheets against air infiltration. For example, U.S. Pat. Nos. 2,361,762 and 2,009,917 disclose devices of this type where felt weatherstripping is used to seal the flexible plastic sheets in their frames. However, the weatherstripping is not used around all four sides of the plastic sheet and is therefore not totally effective. Moreover, felt weatherstripping is easily degradable and may soon become unsuitable for acting as an effective sealing medium. This requires replacement of the felt weatherstripping which is, of course, undesirable.

Other prior art devices disclose various mechanical systems for sealing the plastic sheets in their frames. For example, U.S. Pat. No. 2,847,064 discloses manually inswishes to use the storm window. U.S. Pat. No. 2,769,491 discloses a vertically movable latch bar having a plurality of pivotal tabs which can be moved into engagement for clamping against the plastic sheet. Such an arrangement is, however, unduly complex and expensive.

SUMMARY OF THE INVENTION

One aspect of this invention is the provision of a window unit utilizing flexible plastic sheets as the storm window that incorporates an easily usable and effective means for sealing the plastic sheets in the window casing of the window unit. This better seals the plastic sheets against air passage and allows the sheets to function more effectively as storm windows.

The window unit of this invention provides storm windows for use in conjunction with a transparent window panel having a predetermined area. The window unit comprises a window casing. A plurality of substantially rectangular sealing frames are carried in the window casing. Each of these sealing frames comprises spaced top and bottom frame members joined together by spaced left and right side frame members to define an open interior bounded by the frame members. The frame members are spaced apart sufficiently far such that the open interior is at least approximately the same size as the area of the window panel. The sealing frame are superimposed on top of one another and are configured so that the corresponding frame members thereof are disposed in a mating face-to-face relationship. At least one of the sealing frames is movable in the window casing from a first position in which the sealing frames are spaced apart by a gap to a second position in which the sealing frames are pressed together.

The storm window unit further comprises an air impervious plastic sheet carried in the window casing. This plastic sheet is movable from an operative position in which it opposes and is substantially parallel to the window panel to define the storm window and an inoperative position in which the plastic sheet is removed from its operative position. The plastic sheet in its operative position is interposed into the gap between the sealing frames when the sealing frames are in their first position. In its operative position, the plastic sheet is sufficiently large to cover the open interior of the sealing frames. Then, when the sealing frames are moved to their second position, these frames seal the plastic sheet against air passage by the engagement of the corresponding frame members on the sealing frames with one another with the plastic sheet being trapped therebetween. The window casing is suited to support the plastic sheet adjacent the window panel.

BRIEF DESCRIPTION OF THE DRAWINGS

The present invention will be described hereafter in conjunction with the following drawings, in which like reference numerals will refer to like elements throughout.

DETAILED DESCRIPTION

Figures 1, 2, 4, 5, 6:
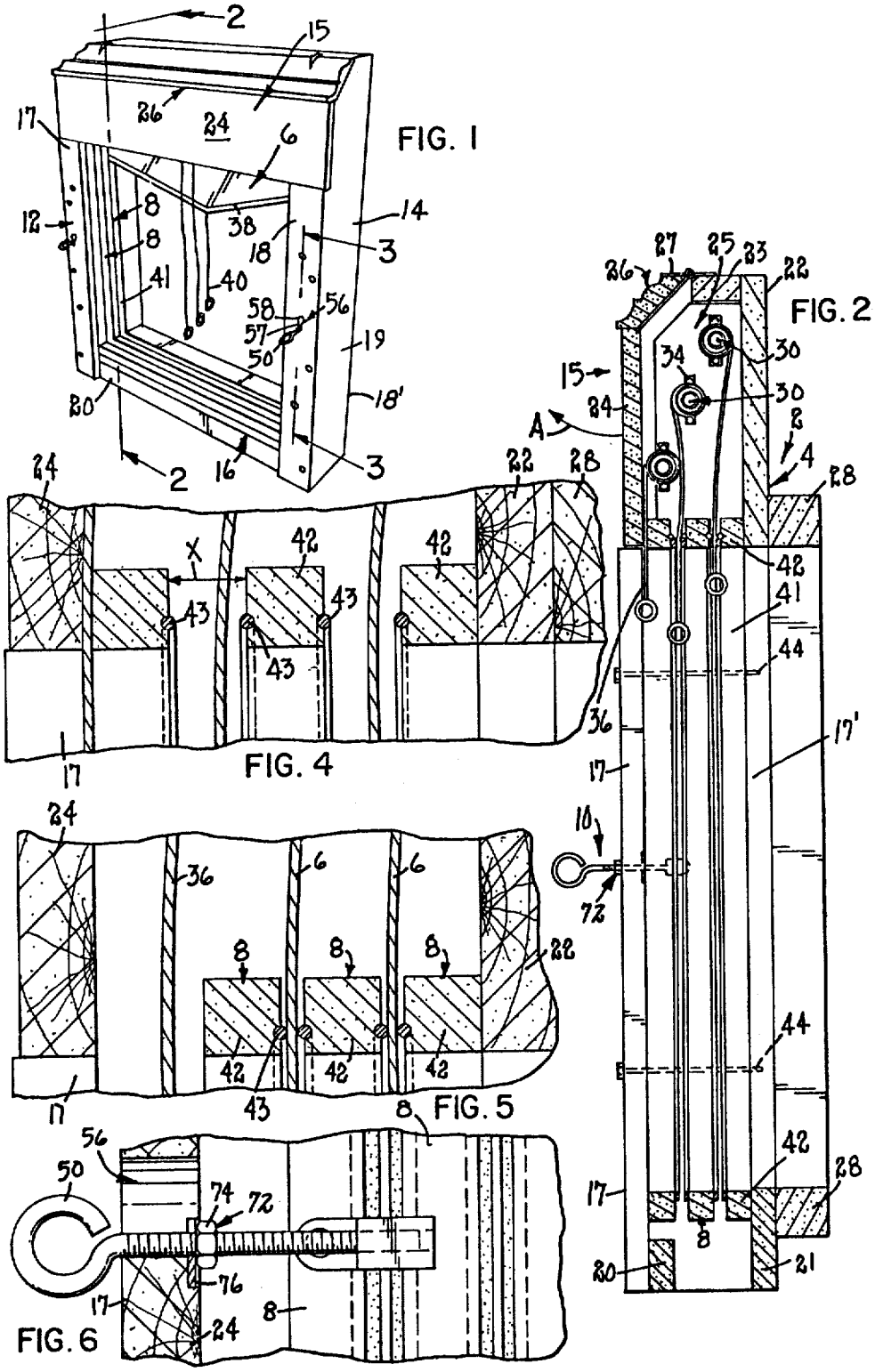
FIG. 1 is a perspective view of a window unit for providing storm windows according to this invention.
FIG. 2 is a cross-sectional view of the window unit shown in FIG. 1, taken along lines 2—2 of FIG. 1, particularly illustrating a plurality of plastic sheets each of which define a storm window.
FIG. 4 is a partial cross-sectional view illustrating the sealing frames placed into their first position where they are separated by a gap into which the plastic sheets may be interposed.
FIG. 5 is a partial cross-sectional view similar to that shown in FIG. 4, particularly illustrating the sealing frames in their second position pressed together for clamping the plastic sheets therebetween.
FIG. 6 is an enlarged perspective view of the means for moving the sealing frames and for locking the sealing frames in their first or second positions as shown in FIG. 3.

Referring first to FIG. 1, a window unit according to this invention for providing storm windows is generally identified as 2. Window unit 2 is particularly designed for providing storm windows for use adjacent a conventional transparent window panel, e.g. a glass pane or the like, installed in a building or other structure. The transparent window panel is not illustrated in the drawings. Window unit 2 may be designed as an add-on unit for retrofitting a separately installed transparent window panel with storm windows. Alternatively, window unit 2 can be designed to be an original or prime window unit in which the transparent window panel is integrally contained in window unit 2. The specific type of transparent window panel used in conjunction with window unit 2 is not important to the present invention.

By way of introduction, window unit 2 comprises a window casing 4. Window casing 4 includes at least one, and preferably more, plastic sheets 6. Each plastic sheet 6 functions as one storm window. Moreover, window unit 2 includes a plurality of rectangular sealing frames 8 for sealing the plastic sheets 6 in casing 4. A means for moving sealing frames 8 between first and second positions relative to casing 4 and plastic sheets 6 is illustrated generally as 10. The moving means 10 includes a means for locking sealing frames 8 in either their first or their second positions along with a means for adjusting the tension with which sealing frames 8 engage one another to seal against the plastic sheets 6. All of these components will be described more specifically hereafter.

WINDOW CASING 4

Window casing 4 is generally rectangular. Casing 4 includes U-shaped side channels 12 and 14, a U-shaped top rail 15, and a bottom sill 16 secured together in any suitable manner, e.g. by nailing these components together. Side channels 12 and 14 include front left and right side rails 17 and 18 which define part of the front face of casing 4. Generally identical rear side rails 17′ and 18′ are located on the rear face of window casing 4. See FIG. 2. Rear side rails 17′ and 18′ are secured to front side rails 17 and 18 by side pieces 19 to define the U-shaped cross-section for side channels 12 and 14. Bottom sill 16 comprises spaced bottom boards 20 and 21 which extend between and are secured to side channels 12 and 14. Alternatively, bottom sill 16 could be U-shaped like the other components of window casing 4.

Referring to FIG. 2, top rail 15 is U-shaped. Top rail 15 includes a vertical rear wall 22, a forwardly extending top wall to but spaced from rear wall 23 to define a hollow roller containing chamber 25. The sides of roller containing chamber 25 are defined by the upper ends of side pieces 19. As shown in FIG. 2, front wall 24 is part of a door 26 pivotally mounted by a hinge 27 to top wall 23. Door 26 normally hangs in a closed position abutting against side pieces 19 for enclosing roller containing chamber 25. However, door 26 may be pivotted upwardly and outwardly in the direction of arrow A to give access to chamber 25 if so desired.

Window casing 4 is suited to be secured in any suitable manner to the wall or other portion of the building in which the transparent window panel is mounted or should be mounted. Referring to FIG. 2, support beams 28 may be secured to the rear of casing 4. Window unit 2 is illustrated herein as an add-on unit designed to be secured to the wall on the inside of the building adjacent a transparent window panel. This is done by nailing or otherwise securing support beams 28 to the wall adjacent the top and bottom of the window panel such that the opposite side or front side of casing 4 faces into the building. Window unit 2 can also be designed as an original piece of equipment in which the transparent window panel would be mounted in a fixed manner along the rear of window casing 4, e.g. between support beams 28. Window casing 4 would then be secured in any suitable manner into the rough opening in the building wall which has been provided for the window unit.

THE PLASTIC SHEETS 6

The storm windows of window unit 2 are defined by a plurality of plastic sheets 6. Preferably, sheets 6 are transparent and flexible so that they can be mounted on spring rollers 30. Spring rollers 30 are fixedly supported in any conventional manner, e.g. using standard support brackets 34, inside roller containing chamber 25 of window unit 2. Two plastic sheets 6 are illustrated in FIG. 2 mounted on two spring rollers 30. Spring rollers 30 are mounted relative to one another so that plastic sheets 6 can be unrolled without interfering with one another. A third flexible sheet 36 is mounted on a spring roller 30 adjacent the front of window casing 4. Sheet 36 comprises an opaque privacy shade or blind of the type often used on windows to block light from passing through the window.

Each plastic sheet 6 is generally rectangular. Referring to FIG. 1, the lower edge 38 of each plastic sheet 6 is V-shaped and has a downwardly depending cord 40 hanging therefrom. Cord 40 is used to unroll sheet 6 to an operative position in which the sheet 6 is unrolled from roller 30 and is drawn downwardly until it is spaced from and opposed to the transparent window panel. In such a position, the plastic sheet 6 acts as a storm window. However, when not in use as a storm window, each plastic sheet may be rolled up onto roller 30 until it is contained solely within the roller containing chamber 25 as shown in FIG. 2. This rolled up condition of the plastic sheet 6 defines an inoperative position thereof, a position in which sheet 6 is no longer opposed to the transparent window panel and thus no longer functions as a storm window.

Plastic sheet 6 may be made from any suitable materials so long as the sheets 6 are impervious to the passage of air. One side of each sheet 6 is preferably made from a heat reflective material. This allows the heat reflective side of the outermost sheet 6 to be located facing the exterior of the building during the summer months to reflect the heat from the summer sun. Similarly, during the winter months, the innermost sheet 6 can be placed to have its heat reflective side facing the interior of the building to reflect back the room heat. This should decrease heating costs during the winter and air conditioning costs during the summer. The use of access door 26 allows the user of window unit 2 to easily remove and reverse the spring rollers 30 carrying the plastic sheets 6 when the seasons change so that the heat reflective side of each plastic sheet 6 is properly positioned.

THE SEALING FRAMES 8

A plurality of rectangular sealing frames 8 are superimposed on top of one another in window casing 4 for sealing sheets 6. Each of the sealing frames 8 is made from spaced vertical side frame members 41 joined at either end to horizontal top and bottom frame members 42. Frame members 41 and 42 are wooden and may be secured together in any conventional manner, e.g. by nailing. Sealing frames 8 are thus made in the manner of a picture frame or the like having an open interior bounded by the frame members. Preferably, the open interior bounded by frame members 41 and 42 is at least as large and preferably somewhat larger than the area of the transparent window panel with which window unit 2 is being used. In addition, each of the plastic sheets 6 is sufficiently large so that when unrolled into its operative position such sheet is able to cover completely the open interior of each of the sealing frames 8.

One of the sealing frames 8, i.e. the rearmost frame, is fixedly secured to window casing 4 adjacent the rear side thereof (the fixed sealing frame 8 is the one furthest to the right in FIG. 2). The other sealing frames 8, however, are movably mounted in window casing 4 for movement towards or away from the fixed sealing frame 8. In this regard, two horizontal guide rods 44 pass through each of the side channels 12 and 14 of casing 4. See FIG. 3. Guide rods 44 are vertically spaced apart in each channel 12 and 14. Each of the movable sealing frames 8 has guide members 46, such as screw threaded eyelets or the like, in side frame members 41. Guide members 46 engage around and slide on guide rods 44 for guiding the movable sealing frames 8 in a straight line movement towards or away from the fixed frame 8. Because guide members 46 engage two vertically spaced apart guide rods 44, sealing frames 8 are prevented from tipping during their movement and maintain a parallel relationship with one another as they are moved towards or away from The movable sealing frames 8 can be moved away from the fixed frame until all the sealing frames 8 are disposed in a first position shown in FIG. 4. In such a position, frames 8 are spaced apart by small gaps of substantially equal length. These gaps are denoted as X in FIGS. 3 and 4. The movable sealing frames 8 can be moved towards the fixed frame until all the frames 8 are disposed in a second position. In this position, frames 8 are pressed together with the corresponding frame members 41 and 42 engaging against one another. See FIG. 5. For example, the top frame member 42 of one sealing frame will be aligned with and engaged against the top frame member 42 of an adjacent sealing frame 8, and so on.

In the first position of sealing frames 8 as shown in FIG. 4, the gaps X are sufficiently large to allow one plastic sheet 6 to be received in each gap X. Then, when sealing frames 8 are moved to their second position, the plastic sheets 6 will become trapped between adjacent sealing frames 8. Preferably, each of the frame members 41 and 42 of each sealing frame 8 includes a resilient seal 43 made from any suitable material. Preferably, seal 43 has a circular cross-section and could be made from a rubber O ring or the like. Seals 43 are placed on sealing frames 8 so that sealing frames 8 do not engage against the plastic sheets 6 directly. Instead, resilient seals 43 will engage against plastic sheets 6 to prevent the sheets from being damaged by contact with the wooden frame members 41 and 42 of the sealing frames 8. In any event, sealing frames 8 effect a secure seal around all four sides of each plastic sheet 6 by virtue of the engagement of the corresponding frame members 41 and 42 of adjacent sealing frames 8 and the compression of seals 43 against sheets 6.

THE MOVING MEANS 10

A moving means 10 is provided for moving or shifting sealing frames 8 from their first to second positions and vise-versa. Moving means 10 comprises two elongated shafts 50 secured to the two side frame members 41 of the outermost sealing frame 8, i.e. the leftmost frame 8 in FIG. 2. Each shaft 50 is pivotally secured to side frame member 41 of the outermost sealing frame. A bearing block 52 is pivotally secured to each side frame member 41 by a pivot pin 53. Bearing block 52 includes a bore in which the inner end 54 of shaft 50 is fixedly received. Bearing block 52 will swing or pivot relative to the side frame members 41 as illustrated by the arrows B in FIG. 3.

A key hole slot 56 is provided in the side rails 17 and 18 of side channels 12 and 13 of window casing 4. Each key hole slot 56 includes a first relatively large portion 58 and a second smaller portion 57. Both of these portions 57 and 58 are large enough to allow shaft 50 to pass therethrough. One shaft 50 passes through each key hole slot 56 to terminate in an enlarged outer end 60. Outer end 60 defines a handle portion of shaft 50 which can be used to manually manipulate sealing frames 8 as described hereafter. Outer end 60 can be the eyelet of a relatively large screw threaded eyelet secured to bearing block 52.

Figure 3:
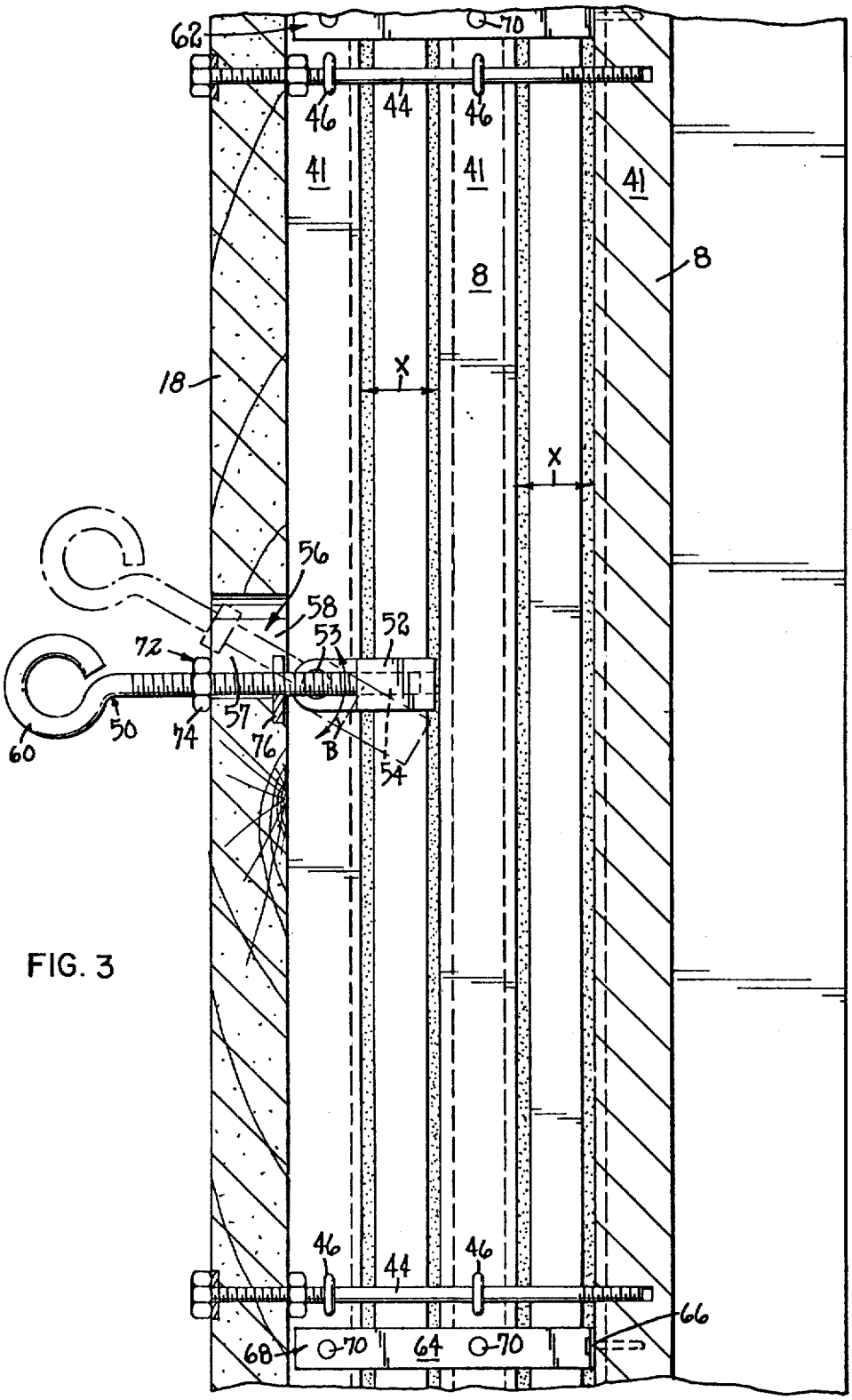
FIG. 3 is a partial cross-sectional view of the window unit shown in FIG. 1, taken along lines 3—3 in FIG. 1, particularly illustrating the means for moving the sealing frames from their first to their second position which means also includes a means for locking the sealing frames in either of these positions.

As each shaft 50 is pushed in or pulled outwardly relative to window casing 4, the outermost sealing frame 8, to which shafts 50 are attached, is moved towards or away from the other sealing frames 8. This also effects the movement of the intermediate sealing frames 8, i.e. the sealing frames between the outermost one and the fixed sealing frame, since a motion transmitting means 62 secures the sealing frames together. Motion transmitting means 62 comprises two flexible straps 64 or the like on each set of side frame members 41. Each strap 64 is fixed at one end 66 to the fixed sealing frame 8 and at the other end 68 to the outermost sealing frame 8. Strap 64 is further secured to the intermediate sealing frames between its ends. Nails 70 or the like are used to secure straps 64 to the side frame members 41 of sealing frames 8. Flexible strap 64 will collapse like an accordion during inward movement of the shafts 50 until the sealing frames are pressed together in their second position shown in FIG. 5. Alternatively, the flexible strap 64 will expand as shown in FIG. 3 to accommodate placement of the sealing frames 8 into their first spaced apart position.

A means for locking the sealing frames in either their first or second positions is also provided. This locking means comprises key hole slots 56, as previously described, and an abutment member 72 on each shaft 50. Abutment member 72 is preferably a threaded nut 74 which engages on the threaded outer diameter of shaft 50. Nut 74 is sufficiently wide so that it can pass through the wide portion 58 of key hole slot 56, but not through the smaller portion 57. While threaded nut 74 is preferred for use as abutment member 72, any type of abutment member which is movable along the length of shaft 50 could be used as long as it is sized as noted earlier.

Nut 74 is engageable either with the inside or outside surfaces of the side rails 17 or 18 to lock the sealing frames 8 in either their first or second positions. Referring to FIG. 3, nut 74 is shown in engagement with the outside surface of the side rail to lock the sealing frames 8 in their first spaced apart position. To unlock the sealing frames 8 and move the sealing frames 8 into their second position, one merely pivots shaft 50 to the phantom line position shown in FIG. 3 in which nut 74 has been aligned with the larger portion 58 of slot 56. Shaft 50 is then moved inwardly through slot 56 until nut 74 has been brought behind side rail 17. Then, shaft 50 is pivotted back to its straight line position where nut 74 is engaged with the inside surface of the side rail. Preferably, the inside surface of the side rail has a metal bearing plate 76 against which nut 74 engages. In this position of nut 74, as shown in FIG. 6, sealing frames 8 are locked in their second position.

The use of a threaded nut 74, or other abutment member 72 which can traverse along the length of shaft 50, is important. This defines a means for adjusting the compression or force which the sealing frames 8 exert against one another in the second position of the sealing frames. All that is required to change this pressure is to simply move the nut up or down the shaft to change the distance of the outermost sealing frame 8 relative to the innermost or fixed sealing frame. Any change in this distance will change the pressure exerted by the frames on one another as they are pressed together. Obviously, if the outermost sealing frame 8 is forced closer to the fixed sealing frame, the pressure exerted on the array of sealing frames 8 is greater than when the outermost frame is further away. The ability to vary the pressure with which sealing frames 8 engage against one another gives one the ability to adjust the pressure exerted on plastic sheets 6. Thus, the pressure of the sealing frames 8 on the plastic sheets 6 can be easily adjusted until the resilient seals 43 compress sufficiently to effect an air tight seal around the four sides of the sealing frames 8.

OPERATION OF THE INVENTION

Window unit 2 is first installed so that it is adjacent a transparent window panel in the building in which it is to be used. This transparent window panel may be integrally contained in window unit 2 as previously noted in which case the entire window unit 2 is simply installed in the manner of a normal window. Once so installed, window unit 2 can be adjusted so that the sealing frames 8 are in their first spaced apart position. The plastic sheets 6 can then be unrolled from spring rollers 30 and drawn downwardly until they entirely cover the open interior bounded by the frame members 41 and 42 of each sealing frame 8. The downward movement of the plastic sheets 6 is aided by the V-shaped lower edge 38 which allows the lower edge of each plastic sheet 6 to easily enter and pass through the gaps X between the sealing frames 8. In any event, plastic sheets 6 will be drawn downwardly into their operative position until they cover the open interior of the sealing frames 8 and are generally parallel to and spaced from the transparent window panel.

Once the plastic sheets 6 have been placed into their operative position, the shafts 50 are then moved from the position shown in FIG. 3 to that shown in FIG. 6. This unlocks the sealing frames 8 from their first position and moves the sealing frames into their second position where they are relocked. In the second position of the sealing frames, the plastic sheets 6 have been trapped between two adjacent sealing frames 8. The compression of the resilient seals 43 against each face of the plastic sheets 6 effects the firm air-tight seal therewith. The privacy shade or blind 36 can then be drawn down in front of the array of plastic sheets 6 as shown in FIG. 5. When the sealing frames 8 have been clamped together in this manner, an air-tight seal has been effected between each of the plastic sheets 6 and window casing 4.

Window unit 2 of this invention has numerous advantages. It allows for the provision of a plurality of storm windows which can be easily rolled up and stored out of sight when not needed. Thus, during the summer when storm windows are not desired, the plastic sheets 6 can be rolled up onto their spring rollers 30 and will not obstruct the view. Furthermore, when it is desired to use plastic sheets 6 as storm windows, all that is required is for the sealing frames 8 to be spaced apart and the sheets 6 then unrolled and interposed between them. This is relatively easy to do compared with the older types of storm windows in which the storm windows have to be removed and replaced with the change of seasons. Moreover, the provision of rectangular sealing frames which seal around all the edges of each plastic sheet is particularly easy and quick to use.

Another advantage of the storm window unit of this invention is its flexibility in allowing heat into the interior of the building in which the window unit is being used. Conventional storm windows which are permanently mounted in front of the window absorb and reflect some of the light energy which would be desired in the dwelling even during the daylight hours. However, the present invention would allow the plastic sheets 6 to be rolled up during the day and let the maximum of heat into the structure. Plastic sheets 6 could then be rolled down during the night and sealed to keep the heat in the interior of the building. The rolling down of the plastic sheets 6 during the nighttime hours could be accomplished automatically, e.g. using a photoelectric cell as darkness approaches.

Various modifications of this invention will be apparent to those skilled in the art. Although two plastic sheets 6 have been illustrated, only one such sheet is strictly necessary and more than two could be utilized if so desired. Accordingly, the scope of this invention is to be limited only by the appended claims.

What is claimed is:

1. A window unit for providing storm windows for use in conjunction with a transparent window panel having a pre-determined area, wherein the unit comprises:

(a) a window casing;

(b) a plurality of substantially rectangular sealing frames carried in the window casing and superimposed on top of one another, wherein each of the sealing frames comprises spaced top and bottom frame members joined together by spaced left and right side frame members to define an open interior bounded by the frame members, wherein the frame members are sufficiently spaced apart such that the open interior is at least approximately the same size as the area of the window panel, wherein the sealing frames are configured so that the corresponding frame members thereof are disposed in a mating face-to-face relationship, and wherein at least one of the sealing frames is movable in the window casing from a first position in which the sealing frames are spaced apart by a gap to a second position in which the sealing frames are pressed together;

(c) an air impervious plastic sheet carried in the window casing, wherein the plastic sheet is movable from an operative position in which the plastic sheet opposes and is substantially parallel to the window panel such that the plastic sheet defines the storm window and an inoperative position in which the plastic sheet is removed from its operative position, wherein the plastic sheet in its operative position is interposed into the gap between the sealing frames when the sealing frames are in their first position with the plastic sheet being sufficiently large to cover the open interior of the sealing frames, whereby the sealing frames in their second position will seal the plastic sheet against air passage around the plastic sheet by the engagement of the corresponding frame members on the sealing frames with one another with the plastic sheet being trapped therebetween, wherein the plastic sheet is flexible and is carried on a spring roller located in the window casing, wherein the operative position of the plastic sheet is a position in which the sheet is unrolled from the spring roller and placed in the opposed relationship to the window panel, and wherein the inoperative position of the plastic sheet is a position in which the sheet is wound up on the spring roller, and wherein a lower edge of the plastic sheet is V-shaped to more easily pass between the sealing frames when the sealing frames are in their first position; and (d) resilient sealing means attached to each of said sealing frames and extending continuously about said top, bottom, left, and right frame members of said frames to engage said plastic sheet when said sheet is in its operative position and when said at least one of the sealing frames is in its second position;

(e) wherein the window ca

2. A window unit as recited in claim 1, wherein the plastic sheet is transparent.

3. A window unit as recited in claim 1, wherein one side of the plastic sheet is heat reflective.

4. A window unit as recited in claim 3, wherein the window casing includes a movable door that normally encloses and covers the spring roller on which the plastic sheet is mounted, wherein the movable door is openable to allow access to the spring roller for reversing the spring roller in the window casing to reverse the heat reflective side of the plastic sheet upon a change of seasons.

5. A window unit as recited in claim 1, wherein the frame members of the sealing frames engage one another with a pre-determined sealing force in the second position of the sealing frames, and further including means for varying the sealing force exerted by the frame members to control the pressure on the plastic sheet when it is trapped between the sealing frames.

6. A window unit as recited in claim 1, further including means for locking the sealing frames in the first or second positions thereof.

7. A window unit as recited in claim 1, wherein the window casing supports the transparent window panel generally adjacent the plastic sheet.

8. A window unit for providing storm windows for use in conjunction with a transparent window panel having a pre-determined area, wherein the unit comprises:

(a) a window casing including left and right side rails;

(b) a plurality of substantially rectangular sealing frames carried in the window casing and superimposed on top of one another, wherein each of the sealing frames comprises spaced top and bottom frame members joined together by spaced left and right side frame members underlying the left and right side rails of the window casing respectively, said frame members defining an open interior bounded by the frame members, wherein the frame members are sufficiently spaced apart such that the open interior is at least approximately the same size as the area of the window panel, wherein the sealing frames are configured so that the corresponding frame members thereof are disposed in a mating face-to-face relationship, and wherein at least one of the sealing frames is movable in the sindow casing from a first position in which the sealing frames are spaced apart by a gap, to a second position in which the sealing frames are pressed together;

(c) two elongated shafts which respectively extend through the siderails of the window casing to be received in the side frame members of the movable sealing frame, wherein the elongated shafts terminate at a location exterior of the siderails of the window casing to define a handle portion which may be manipulated to move the movable sealing frame inwardly or outwardly relative to the siderails by pushing or pulling on the handle portions of the shafts;

(d) an air impervious plastic sheet carried in the window casing, wherein the plastic sheet is movable from an inoperative position in which the plastic sheet opposes and is substantially parallel to the window panel such that the plastic sheet defines the storm window, and an inoperative position in which the plastic sheet is removed from its operative position, wherein the plastic sheet, in its operative position, is interposed in the gap between the sealing frames when the sealing frames are in their first position with the plastic sheet being sufficiently large to cover the open interior of the sealing frames, whereby the sealing frames in their second position will seal the plastic sheet against air passage around the plastic sheet by the engagement of the corresponding frame members on the sealing frames with one another with the plastic sheet being trapped therebetween;

and (e) wherein the window casing is suited to support the plastic sheet adjacent the window panel.

9. A window unit as recited in claim 8, wherein the locking means cooperates with the elongated shafts to hold the shafts in either of two adjusted positions corresponding to the first or second positions of the sealing frames.

10. A window unit as recited in claim 9, wherein each side rail of the window casing has an inner and outer surface and a key hole slot passing therethrough, wherein the key hole slot includes a first relatively large portion and a second smaller portion; wherein the elongated shafts are pivotally received in the side frame members of the mvoable sealing frame, wherein each shaft includes an abutment member along the length thereof which abutment member is sized to pass through the large portion of the key hole slot but to be stopped by the smaller portion of the slot, and wherein the sealing frames may be locked in either their first or second positions by virtue of the abutment member frame until the abutment member is received over the larger portion of the key hole slot allowing the shaft to be pushed or pulled through the slot.

11. A window unit as recited in claim 9, wherein the frame members of the sealing frames engaged one another with a pre-determined sealing force in the second position of the sealing frames, and further including means for varyinthe frame members to control the pressure on the plastic sheet when it is trapped between the sealing frame.

12. A window unit as recited in claim 11, wherein the abutment member in engagement with the inside surface of the side rail to lock the sealing frames in the second position thereof, controls the sealing force, and wherein the abutment member is movable along the length of the shaft to vary the sealing force exerted by the frame members of the sealing frames on one another by varying the position of the movable sealing frame in the second position of the sealing frames.

13. A window unit for providing storm windows for use in conjunction with a transparent window panel having a predetermined area, wherein the unit comprises:

(a) a window casing;

(b) a plurality of substantially rectangular sealing frames carried in the window casing and superimposed on top of one another, wherein each of the sealing frames comprises spaced top and bottom frame members joined together by spaced left and right side frame members to define an open interior bounded by the frame members, wherein the frame members are sufficiently spaced apart such that the open interior is at least approximately the same size as the area of the window panel, wherein the sealing frames are configured so that the corresponding frame members thereof are disposed in a mating face-to-face relationship, and wherein a plurality of the sealing frames are configured for movement in the window casing between first positions wherein the sealing frames are spaced apart by gaps, and second positions in which the sealing frames are pressed together;

(c) a plurality of air impervious plastic sheets carried in the window casing, each of the sheets being movable in one of said gaps from an operative position in which it is opposite and substantially parallel to the window panel such that it defines a storm window, and an inoperative position in which it is removed from its operative position, wherein each sheet, in its operative position, is interposed in one of the gaps between the sealing frames when the sealing frames are in their first positions with the sheets being sufficiently large to cover the open interiors of the sealing frames, whereby the sealing frames in their second positions will seal the plastic sheets against air passage around the plastic sheets by the engagement of the corresponding frame members on the sealing frames with one another with a plastic sheet being trapped between two of said sealing frames; and (d) wherein the window casing is suited to support the plastic sheets adjacent the window panel.

14. A window unit as recited in claim 13, wherein one of the sealing frames is fixed relative to the window casing and the other sealing frames are all movable to allow the sealing frames to be placed in the first position with adjacent sealing frames spaced apart by the gap.

15. A window unit as recited in claim 14, further including means for manually moving one of the movable sealing frames inwardly or outwardly in the window casing, and further including motion transmitting means extending between the manually movable sealing frame and the other movable sealing frames to pull all of the sealing frames into their first position.

* * * * *